United States Patent [19]

Saito et al.

[11] Patent Number: 4,911,052

[45] Date of Patent: Mar. 27, 1990

[54] KEY ASSIGNER SYSTEM FOR ELECTRONIC MUSICAL INSTRUMENT

[75] Inventors: Tsutomu Saito; Kazunari Inaba, both of Shizuoka, Japan

[73] Assignee: Kabushiki Kaisha Kawai Gakki Seisakusho, Shizuoka, Japan

[21] Appl. No.: 92,818

[22] Filed: Sep. 3, 1987

[30] Foreign Application Priority Data

Sep. 6, 1986 [JP] Japan ..... 61-209980

[51] Int. Cl.[4] ..... G10H 1/22; G10H 1/46

[52] U.S. Cl. ..... 84/617; 84/682; 84/DIG. 2

[58] Field of Search ..... 84/1.01, 1.13, DIG. 2, 84/1.1, 1.22, 1.23, 1.26

[56] References Cited

U.S. PATENT DOCUMENTS

| | | | |
|---|---|---|---|
| *Re. 31,931 | 7/1985 | Tomisawa | 84/1.01 |
| 4,041,825 | 8/1977 | Pascetta | 84/1.01 |
| 4,041,826 | 8/1977 | Oya | 84/1.01 |
| 4,335,639 | 6/1982 | Okamoto | 84/1.01 |
| 4,357,849 | 11/1982 | Ezawa et al. | 84/1.01 |
| 4,481,851 | 11/1984 | Swain et al. | 84/1.01 |
| 4,558,624 | 12/1985 | Tomisawa et al. | 84/1.13 X |
| 4,570,520 | 2/1986 | Deutsch et al. | 84/1.01 |
| 4,703,680 | 11/1987 | Wachi et al. | 84/1.01 X |
| 4,706,538 | 11/1987 | Yoshida | 84/DIG. 2 X |

*Primary Examiner*—Stanley J. Wilkowski
*Attorney, Agent, or Firm*—Sughrue, Mion, Zinn, Macpeak & Seas

[57] ABSTRACT

A key assigner system for an electronic musical instrument having an assignment memory assignment channel number N equal to or less than the number of signal sources of a musical tone signal generator for storing information such as a key number and/or an ON/OFF state of a key, a closed-keys sequence memory having the same number N of words as the channel number for storing channel name, and a processor for writing or reading ON/OFF states of key switches according to information from scanning ON/OFF states of key switches. There is at least one key OFF channel in the assignment memory, apparatus for detecting the least recently closed key channel of key OFF channels according to information of the closed-keys sequence memory when a newly closed key is detected to assign the channel as the channel of the newly closed key, and apparatus for detecting the channel of the least recently closed key of key ON channels according to information of the closed-keys sequence memory when N channels are all in a key ON state closure of a newly-depressed key key is detected to assign the channel as the channel of the newly closed key, thereby processing at a high speed with a simplified arrangement, so that a player feels no inconvenience during a performance.

5 Claims, 9 Drawing Sheets

FIG. 4

| | | | | | | | |
|---|---|---|---|---|---|---|---|
| ON/OFF | INITIAL TOUCH | | | | | | $(C_2)$ |
| ON/OFF | INITIAL TOUCH | | | | | | $(C_2^{\#})$ |
| ON/OFF | INITIAL TOUCH | | | | | | $(D_2)$ |
| ON/OFF | INITIAL TOUCH | | | | | | $(D_2^{\#})$ |
| ON/OFF | INITIAL TOUCH | | | | | | $(E_2)$ |
| ⋮ | | | | | | | |
| ON/OFF | INITIAL TOUCH | | | | | | |
| ⋮ | | | | | | | |
| $S_2$ $(D_2^{\#})$ | $S_2$ $(D_2)$ | $S_2$ $(C_2^{\#})$ | $S_2$ $(C_2)$ | $S_1$ $(D_2^{\#})$ | $S_1$ $(D_2)$ | $S_1$ $(C_2^{\#})$ | $S_1$ $(C_2)$ |
| $S_2$ $(G_2)$ | $S_2$ $(F_2^{\#})$ | $S_2$ $(F_2)$ | $S_2$ $(F_2)$ | $S_1$ $(G_2)$ | $S_1$ $(F_2^{\#})$ | $S_1$ $(F_2)$ | $S_1$ $(E_2)$ |
| $S_2$ $(B_2)$ | $S_2$ $(A_2^{\#})$ | $S_2$ $(A_2)$ | $S_2$ $(G_2^{\#})$ | $S_1$ $(B_2)$ | $S_1$ $(A_2^{\#})$ | $S_1$ $(A_2)$ | $S_1$ $(G_2^{\#})$ |
| $S_2$ $(D_3^{\#})$ | $S_2$ $(D_3)$ | $S_2$ $(C_3^{\#})$ | $S_2$ $(C_3)$ | $S_1$ $(D_3)$ | $S_1$ $(D_3)$ | $S_1$ $(C_2^{\#})$ | $S_1$ $(C_2)$ |
| ⋮ | | | | | | | |
| — | — | — | $S_2$ $(C_7)$ | — | — | — | $S_2$ $(C_7)$ |
| ⋮ | | | | | | | |

FIG. 5

| | | | | | | | |
|---|---|---|---|---|---|---|---|
| $D_2^{\#}$ | $D_2$ | $C_2^{\#}$ | $C_2$ | — | — | — | — |
| $G_2$ | $F_2^{\#}$ | $F_2$ | $E_2$ | — | — | — | — |
| $B_2$ | $A_2^{\#}$ | $A_2$ | $G_2^{\#}$ | — | — | — | — |
| $D_3^{\#}$ | $D_3$ | $C_3^{\#}$ | $C_3$ | — | — | — | — |
| $G_3$ | $F_3^{\#}$ | $F_3$ | $E_3$ | — | — | — | — |
| $B_3$ | $A_3^{\#}$ | $A_3$ | $G_3^{\#}$ | — | — | — | — |
| $D_4^{\#}$ | $D_4$ | $C_4^{\#}$ | $C_4$ | — | — | — | — |
| $G_4$ | $F_4^{\#}$ | $F_4$ | $E_4$ | — | — | — | — |
| $B_4$ | $A_4^{\#}$ | $A_4$ | $G_4^{\#}$ | — | — | — | — |
| $D_5^{\#}$ | $D_5$ | $C_5^{\#}$ | $C_5$ | — | — | — | — |
| $G_5$ | $F_5^{\#}$ | $F_5$ | $E_5$ | — | — | — | — |
| $B_5$ | $A_5^{\#}$ | $A_5$ | $G_5^{\#}$ | — | — | — | — |
| $D_6^{\#}$ | $D_6$ | $C_6^{\#}$ | $C_6$ | — | — | — | — |
| $G_6$ | $F_6^{\#}$ | $F_6$ | $E_6$ | — | — | — | — |
| $B_6$ | $A_6^{\#}$ | $A_6$ | $G_6^{\#}$ | — | — | — | — |
| — | — | — | $C_7$ | — | — | — | — |

FIG. 7

| ADDRESS | | | | | |
|---|---|---|---|---|---|
| 0 | ON/OFF | — | — | — | CHANNEL # |
| 1 | ON/OFF | — | — | — | CHANNEL # |
| 2 | ON/OFF | — | — | — | CHANNEL # |
| 3 | ON/OFF | — | — | — | CHANNEL # |
| 4 | ON/OFF | — | — | — | CHANNEL # |
| 5 | ON/OFF | — | — | — | CHANNEL # |
| 6 | ON/OFF | — | — | — | CHANNEL # |
| 7 | ON/OFF | — | — | — | CHANNEL # |
| 8 | ON/OFF | — | — | — | CHANNEL # |
| 9 | ON/OFF | — | — | — | CHANNEL # |
| 10 | ON/OFF | — | — | — | CHANNEL # |
| 11 | ON/OFF | — | — | — | CHANNEL # |

OLD KEY CLOSED →

FIG. 6

| | | |
|---|---|---|
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |
| ON/OFF | KEY # | |
| INITIAL TOUCH DATA | | ZONE |

FIG. 8

← OLD KEY CLOSED

| | | | | | | | | | | | | | |
|---|---|---|---|---|---|---|---|---|---|---|---|---|---|
| | 0CH OFF | 1CH OFF | 2CH OFF | 3CH OFF | 4CH OFF | 5CH OFF | 6CH OFF | 7CH OFF | 8CH OFF | 9CH OFF | ACH OFF | BCH OFF | (8-1) |
| ADDRESS | 0 | 1 | 2 | 3 | 4 | 5 | 6 | 7 | 8 | 9 | 10 | 11 | |
| | ACH ON | 1CH ON | 5CH ON | BCH ON | 6CH ON | 4CH OFF | 0CH OFF | 3CH OFF | 9CH OFF | 2CH OFF | 8CH OFF | 7CH OFF | (8-2) |
| ADDRESS | 0 | 1 | 2 | 3 | 4 | 5 | 6 | 7 | 8 | 9 | 10 | 11 | |
| | ACH ON | 1CH ON | 5CH ON | | 6CH ON | 4CH OFF | 0CH OFF | 3CH OFF | 9CH OFF | 2CH OFF | 8CH OFF | 7CH OFF | (8-3) |
| | ACH ON | 1CH ON | 5CH ON | 6CH ON | 4CH OFF | 0CH OFF | 3CH OFF | 9CH OFF | 2CH OFF | 8CH OFF | 7CH OFF | | (8-4) |
| | ACH ON | 1CH ON | 5CH ON | 6CH ON | 4CH OFF | 0CH OFF | 3CH OFF | 9CH OFF | 2CH OFF | 8CH OFF | 7CH OFF | BCH ON | (8-5) |
| ADDRESS | 0 | 1 | 2 | 3 | 4 | 5 | 6 | 7 | 8 | 9 | 10 | 11 | |
| | ACH ON | 1CH ON | 5CH ON | 6CH ON | 4CH OFF | 0CH OFF | 3CH OFF | 9CH OFF | 2CH OFF | 8CH OFF | 7CH OFF | BCH OFF | (8-6) |
| ADDRESS | 0 | 1 | 2 | 3 | 4 | 5 | 6 | 7 | 8 | 9 | 10 | 11 | |
| | ACH ON | 1CH ON | 5CH ON | 6CH ON | 4CH OFF | 1CH OFF | 3CH OFF | 9CH OFF | 2CH OFF | 8CH OFF | 7CH OFF | BCH ON | (8-7) |

← OLD KEY CLOSED

| | | | | | | | | | | | | | |
|---|---|---|---|---|---|---|---|---|---|---|---|---|---|
| | ACH ON | 1CH ON | 5CH ON | 6CH ON | 0CH ON | 3CH ON | 9CH ON | 2CH ON | 8CH ON | 7CH ON | BCH ON | 4CH ON | (8-8) |
| ADDRESS | 0 | 1 | 2 | 3 | 4 | 5 | 6 | 7 | 8 | 9 | 10 | 11 | |
| | | 1CH ON | 5CH ON | 6CH ON | 0CH ON | 3CH ON | 9CH ON | 2CH ON | 8CH ON | 7CH ON | BCH ON | 4CH ON | (8-9) |
| | 1CH ON | 5CH ON | 6CH ON | 0CH ON | 3CH ON | 9CH ON | 2CH ON | 8CH ON | 7CH ON | BCH ON | 4CH ON | | (8-10) |
| | 1CH ON | 5CH ON | 6CH ON | 0CH ON | 3CH ON | 9CH ON | 2CH ON | 8CH ON | 7CH ON | BCH ON | 4CH ON | ACH ON | (8-11) |
| ADDRESS | 0 | 1 | 2 | 3 | 4 | 5 | 6 | 7 | 8 | 9 | 10 | 11 | |

KEY ASSIGNER SYSTEM FOR ELECTRONIC MUSICAL INSTRUMENT

BACKGROUND OF THE INVENTION

The present invention relates to a key assigner system for an electronic musical instrument which comprises a key assigner for writing operating states of keys in a memory and a processor for reading out the operating states to produce tones.

The number of signal sources of a musical tone generator is less than a number of keys in an electronic musical instrument. When approximately the same number of keys as the number of channels are closed, "an assigner" for arranging and designating tone sources for generating tones is required. Necessary processing time (or processing speed) of the processor tends to becomes greater when plural keys are closed, causing delays. Therefore, it would be desirable to develop a system for processing the operating states earlier developed.

FIG. 9 is a block diagram showing an arrangement of an electronic musical instrument. The electronic musical instrument includes key switches 1 for keys, a key assigner 2, a musical tone signal generator 3, an envelope generator 4, an envelope memory 5, a signal amplifier 6 and a speaker 7. The key assigner 2 has a microprocessor 20, an assignment memory 21, a closed-keys sequence memory 22 and a released keys sequence memory 23. Closed-key operation information in the key switch 1 is scanned from the key assigner 2 to detect a closed-key position and a touching speed. The closed-key information is ordinarily stored in a memory contained in the key assigner 2. The envelope generator 4 generates an envelope signal according to information read out from the memory, and applies the envelope signal to the musical tone signal generator 3. A closed-key operation signal is partly applied from the key assigner 2 directly to the musical tone signal generator 3 which, in turn, generates a predetermined musical tone, which is modulated by an envelope signal from the envelope generator 4. The speaker 7 audibly reproduces the musical tones.

The following three types of processing systems of the key assigner 2 heretofore have been realized.

(1) "Previously-closed-key priority assigner"

This is a system for assigning storage areas of a memory in the sequence of detected closed keys to store the closed keys on a time base. This system has a simple processing.

(2) "Higher-tone priority assigner"

Of a system called "middle-tone-omission assigner", this is a system for assigning an S channel from a lower tone side of a closed-key code and a T channel from a higher tone side of a closed-key code on an axis on which tones are aligned in a sequence of pitches of the tones (S+T=N). In this system, the tones are not processed on a time base, but a player does not still feel an inconvenience. Everytime a new closed-key is detected, this system requires reassignment of all N channels.

(3) "Later-closed-key priority assigner"

This is a system for preferentially assigning a later-closed key on a time base when closed keys are sequentially detected on the time base. A method of determining channels to be assigned is complicated. For example, this system assigns the later-closed key for a channel which is keyed OFF at the earliest time of all the key OFF channels when there are the key OFF channels in the assigned channels. If all the channels are key ON channels, the system assigns the later-closed key for a channel which is keyed ON at the earliest time of all the key ON channels. A player does not feel an inconvenience at the most in this system. To execute this system, as shown in FIG. 9, the system needs an assignment memory 21, a closed-keys sequence memory 22 and a released-keys sequence memory 23. The microprocessor 20 of this system processes information in the memories. More specifically, if information is not assigned for all the memories, the released-keys sequence memory 23 is referred to unfilled channels, and the information is assigned for a channel which is the earliest one to be OFF. If all the channels are being used, the closed-keys sequence memory 22 is referred, and the information is rewritten in the channel which is the earliest one to be keyed OFF at the earliest.

In the arrangement of the system shown in FIG. 9, three sets of memories are required, and the microprocessor requires a large quantity of time to process the information in the memories. Thus, this system has such disadvantages that an expensive, high speed processor is required.

SUMMARY OF THE INVENTION

An object of the present invention is to provide a key assigner system for an electronic musical instrument which can eliminate the above-mentioned drawbacks, and which can process at a high speed with a simplified arrangement and which does not make a player feel inconvenience during a performance.

In order to achieve the above and other objects, a key assigner system for an electronic musical instrument according to the present invention having an assignment memory having an assignment channel number N equal to or less than the number of signal sources of a musical tone signal generator for storing information such as a key number and/or an ON/OFF state of a key, a closed-keys sequence memory having a number of words equal to the channel number N for storing a channel name, and a processor for controlling writing or reading of the ON/OFF state of key switches according to scanned information corresponding to the ON/OFF of key switches comprising means having at least one key OFF channel in the assignment memory for detecting the least recently depressed key channel of key OFF channels according to information stored in the closed-keys sequence memory when a newly closed key is detected to assign the channel as the channel of the newly closed key, and means for detecting the channel of the most previously closed key of key ON channels according to information stored in the closed-keys sequence memory when N channels are all key ON channel and a newly closed key is detected to assign the channel as the channel of the newly closed key.

BRIEF DESCRIPTION OF THE DRAWINGS

FIG. 4 is a diagram of data stored in an initial touch data memory and a new key data memory;

FIG. 5 is a diagram of data stored in an old memory;

FIG. 6 is a diagram of data stored in an assignment memory;

FIG. 7 is a diagram of data stored in a closed-keys sequence memory;

FIG. 8 is a diagram for describing the used state of the closed-keys sequence memory.

DETAILED DESCRIPTION OF THE PREFERRED EMBODIMENTS

Figure 1:
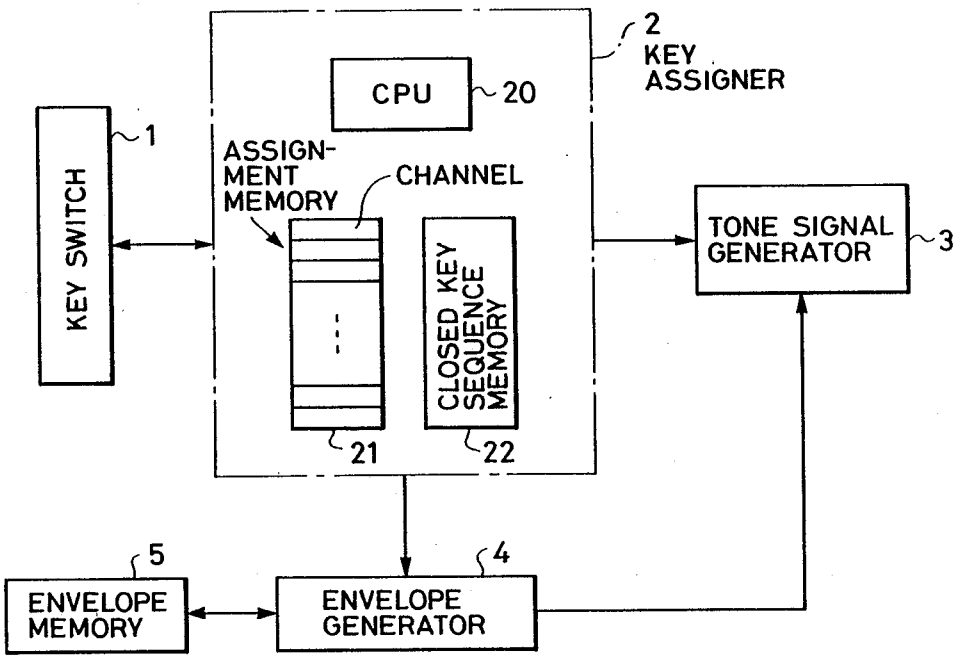
FIG. 1 is a block diagram of an arrangement of a principle of the present invention.

FIG. 1 is a block diagram of an arrangement of a principle of the present invention. In FIG. 1, reference numeral 1 denotes a key switch, numeral 2 denotes a key assigner, numeral 3 denotes a musical tone signal generator, numeral 4 denotes an envelope generator, numeral 5 denotes an envelope memory, numeral 20 denotes a microprocessor, numeral 21 denotes an assignment memory, and numeral 22 denotes a closed-keys sequence memory.

The assignment memory 21 has a number N of assignment channels, equal to or less than the number of signal sources in the musical tone signal generator 3, to store information such as key numbers and key ON/OFF. The closed-keys sequence memory 22 has the same number of words N as the number of the channels to store channel names. The processor 20 controls scanning of the key switches 1 and writing into or reading out from the memories according to the scanned information signifying the ON and OFF of the key switches 1. The key assigner system of the present invention comprises the following arrangement in an electronic musical instrument having the assigner 2 and the musical tone signal generator 3 constructed as described above.

The microprocessor 20 checks the assigning state of the assignment memory 21 and assigns a newly depressed key to the channel of the earliest detected closed-key of the key OFF channels when there is at least one key OFF channel and a newly closed key is detected. The microprocessor 20 assigns a newly depressed key for the channel of the earliest closed depressed-key of the key ON channels when all the channels are in a key ON state and the newly closed key is detected.

When the microprocessor 20 of the key assigner 2 scans the key switches 1 to know that a key switch 1 is operated such as by the fact that a key ON state is detected, the microprocessor 20 searches for the channel storing the oldest closed key and searches for the oldest channel of the key OFF channels, and stores necessary information in the assignment memory 21 and the depressed-keys sequence memory 22. The process of the microprocessor 20 is determined according to the presence or absence of the key OFF channel in the assignment memory 21 as described above.

When the microprocessor 20 detects the key OFF state, the microprocessor 20 writes the key OFF data in the assignment memory 21 to process the OFF information in the closed-key sequence memory 22.

The microprocessor 20 assigns a newly closed key for a channel having the same key number when the newly closed key having the same key number as the key number of the channel that has been already assigned is generated in the assignment memory 21.

Figure 2:
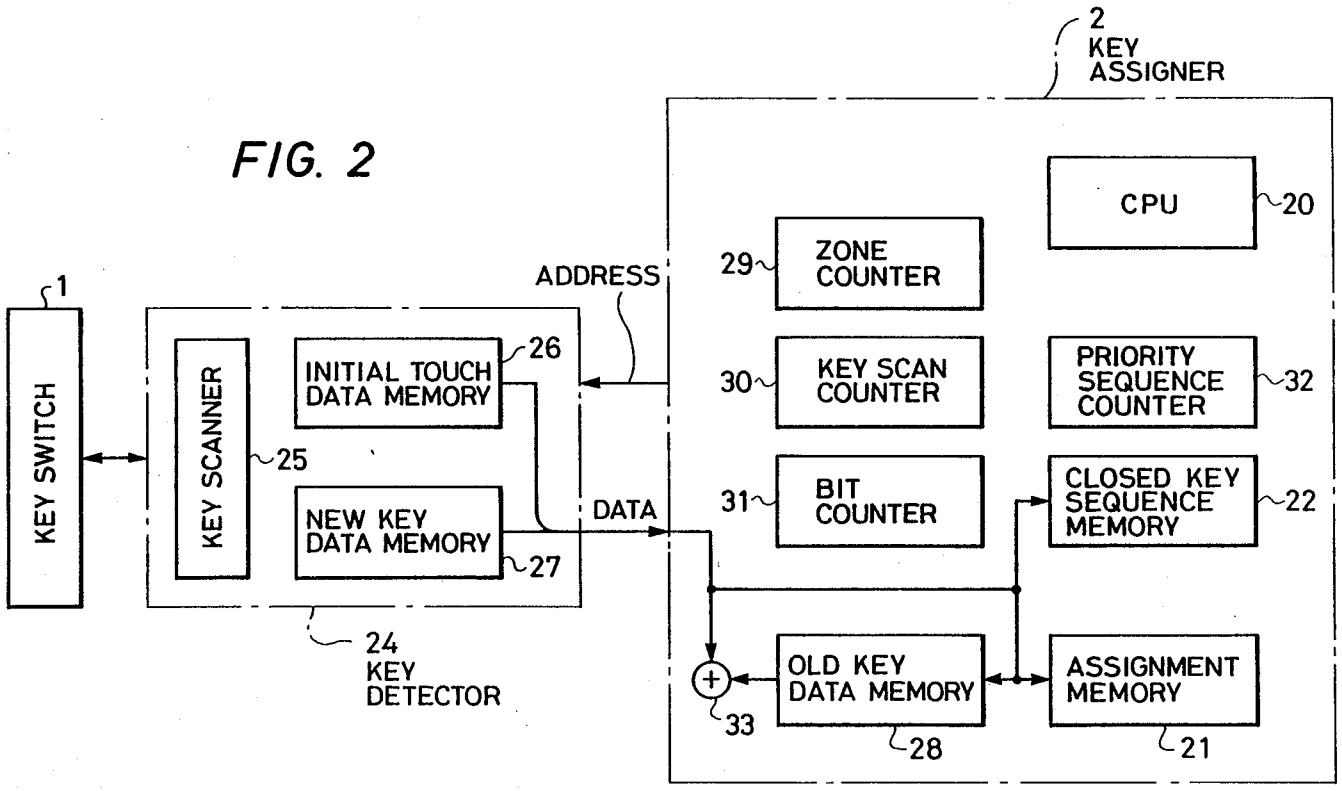
FIG. 2 is a block diagram of an embodiment of the present invention.

FIG. 2 is a block diagram of an arrangement of an embodiment of a key assigner system according to the present invention. A key assigner 2 must scan key switches 1 to detect the closing and releasing states of the keys as described above. To this end, a key detector 24 shown in FIG. 2 is provided, and the key detecto r 24 has a key scanner 25, an initial touch data memory 26, and a new key data memory 27. The key assigner 2 has, in addition to microprocessor 20, an assignment memory 21, a closed-keys sequence memory 22, an old key data memory 28, a zone counter 29, a key scan counter 30, a bit counter 31, a priority sequence counter 32 and an EOR circuit 33.

Figure 3A:
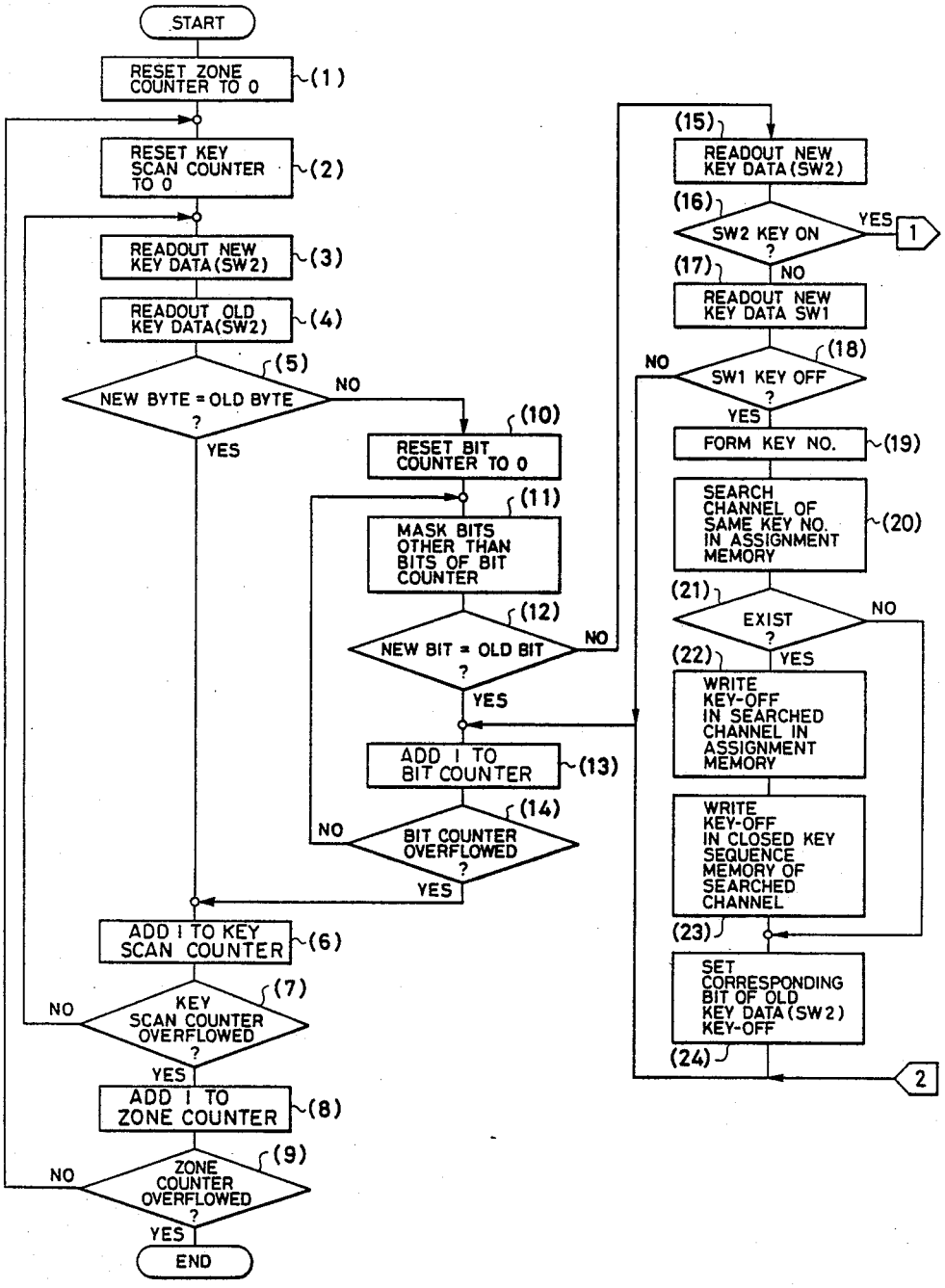
FIGS. 3A and 3B are flow charts describing the operation of the embodiment of FIG. 2.
Figure 3B:
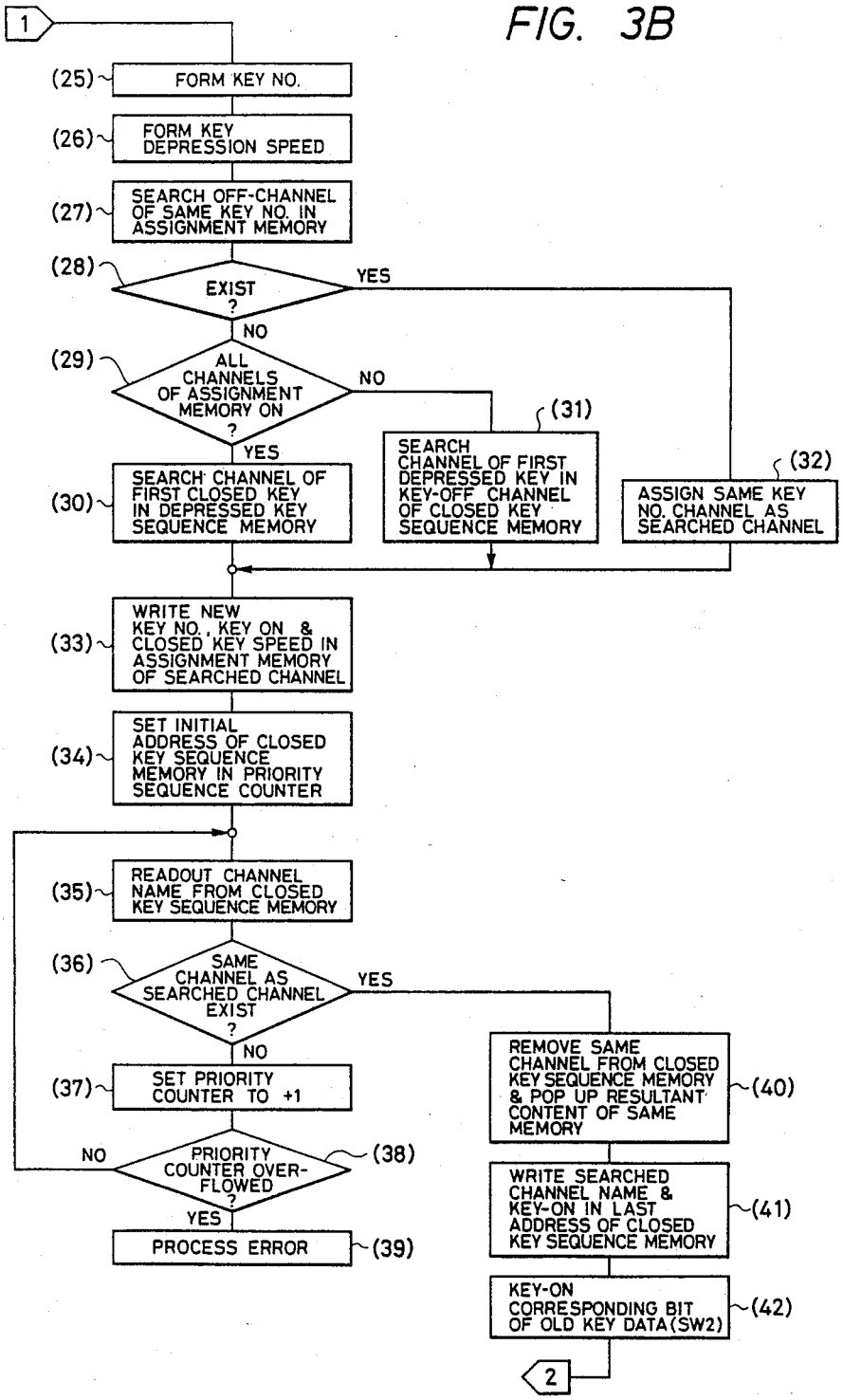
Figure 9:
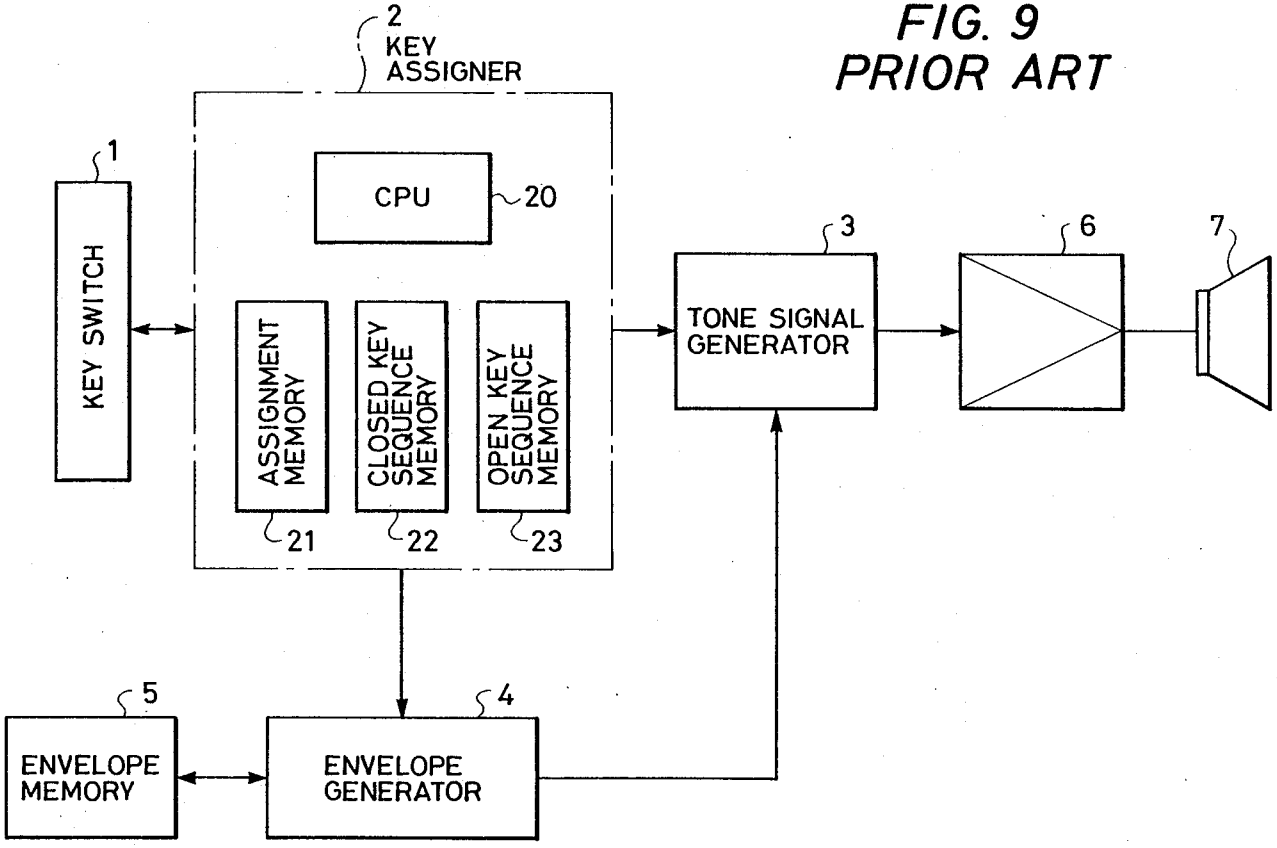
FIG. 9 PRIOR ART
FIG. 9 is a block diagram of an arrangement of a conventional electronic musical instrument.

The processing operation of the key assigner 2 will be described with reference to the flowcharts in FIG. 3 illustrating the process of the key assigner 2. The zone counter 29 is set to zero in step (1) in FIG. 3A. The key scan counter 30 is then set to zero in step (2). The microprocessor 20 reads out new key data, that is, the data of address "0" from the new key data memory 27 in step (3) in FIG. 3A. The microprocessor 20 then reads out the data corresponding to the key scan counter 30, that is, the data of address "0" from the old key data memory 28 for storing the data scanned previously for the state of the second contact SW2 in step (3) in FIG. 3A. The microprocessor 20 compares the old key data with new key data obtained by newly scanning the key switch 1 in step (5) by using the EOR circuit 33. The data to be compared is 4 bits long, to enable simultaneous detection of ON/OFF changes of four keys. When no change is detected, the key scanner 25 then similarly processes by adding +1 in the key scan counter 30 in step (6). When the key scan counter 30 overcounts in step (7), the key scanner 25 performs a similar process by adding +1 in the zone counter 29 in step (8). When the zone counter 29 overcounts in step (9), the process is ended. The detecting speed of the key state change is accelerated by the operation of the key scanner 25, and the load of the microprocessor 20 thus is decreased. The above-described word "zone" identifies a keyboard and is defined, for example, as in the Table below.

| Zone | Keyboard |
|---|---|
| 0 0 | Solo |
| 0 1 | upper |
| 1 0 | lower |
| 1 1 | foot |

The data storage of the initial touch data memory 26 and the old key data memory 27 by the key scanner 25 now will be described. FIG. 4 shows the case of a musical instrument having a keyboard including 61 keys. The initial touch data memory 26 stores the detected speed of the closed-key and is constructed in 7 bit configuration in FIG. 4. The most significant bit illustrates the state of the second contact SW2; "1", for example, indicates a key ON state, and "0" indicates a key OFF state. The addresses correspond on a one to one basis with the keys of the keyboard, and a smaller address illustrates a lower pitch of tone. The address 80H or lower illustrates the state of the switch. The first contact SW1 is designated by S1, and the second contact SW2 is depicted by S2. Thus, S2 is the same as the most significant bit of the byte of the initial touch data of the corresponding key. There is no key in the keyboard at the position marked by "–".

FIG. 5 shows the data storage of the old key data memory 27. In the configuration of the memory information of all the keys can be stored by 16 bytes, and ON/OFF states of the respective keys are indicated by four more significant bits of one byte. This configuration is the same as the contents of the second contact SW2 in the lower portion of FIG. 4, and this memory stores new data only when a state change occurs.

Referring back to FIG. 3A, the processing operation of the key assigner 2 from the step (5) for branching the conditions will be continued. When the state change is detected in step (5) in FIG. 3A, the bit counter 31 is set to zero "0" in step 10. Here, the appropriate portion of the initial touch data memory 26 is examined to see which of the 4 bits of data has changed. To this end, to sequentially examine 4 bits from the least significant bit, bits except a zero number bit indicated in the bit counter 31 are masked in step (11), and the state of the new bit is compared with that of the old bit again in step (12). If no change occurs in step (12), +1 is added to the bit counter 31 in step (13). This process is repeated until a change occurs, and the bit in which change occurs is checked in step (15). Thus, when the data bit is, for example, "1", it is judged that the bit is changed to key ON, while when the data bit is "0", it is judged that the bit is changed to key OFF, and the operation is transferred to the respective processes.

KEY OFF PROCESS

Since the bit in which key OFF is detected is only information of the second contact SW2 as described above, it is necessary to confirm information of the first contact SW1. Thus, new key data (SW1) is read out in step (17), and whether the new key data (SW1) is key OFF is checked in step (18) in FIG. 3A to check whether the first contact SW1 is OFF or not. After then confirming the key OFF, a key number is obtained in step (19). Then, the channel of the same key number is searched in the assignment memory 21 in step (20), and the existence of a channel in the key ON state corresponding to the key number of a key OFF state in the assignment memory 21 is checked in step (21). When the channel of the key ON state is searched in the assignment memory 21, the key OFF is assigned or written for the channel (in which the ON/OFF bit is merely turned to OFF in actual process) in the assignment memory 21 in step (22). If there is no channel even if all 12 channels are searched, the key OFF assignment is not executed, but the old key data memory 28 is rewritten in step (24). When the key OFF data is assigned or written in the memory, the key OFF data is written in the searched channel in the closed-keys sequence memory 22 in step (23) to be described later. This process searches for the same channel number as the channel in which the key OFF data is assigned or written from the closed-key sequence memory 22 so that the ON/OFF bit should be ON in the channel, and sets that bit to OFF. Then, the corresponding bit of the old key data memory 28 is set to key OFF. The ON/OFF bit in the closed-keys sequence memory 22 is eliminated, and the ON/OFF bit in the assignment memory 21 may be referred.

KEY ON PROCESS

When the key ON in the new key data (SW2) is detected in step (16) in FIG. 3A, the key ON data is assigned or written in the memory. A key number is first formed in step (25) in FIG. 3B. Then, initial touch data such as the speed of a depressed key is formed in step (26) (continued from FIGS. 3A to 3B). Since the key number is unitarily defined by the values of the key scan counter 30 and the bit counter 31, it is formed by adding a predetermined value to it. When the keys C2 to C7, for example, are scanned, the scan counter 30 and the bit counter 31 are "0". If the key number of C0 is set to "0", 24 is added thereto as the predetermined value. Since primary initial touch data (data indicating the speed with which a key is closed) is obtained in the key scanner 25, predetermined data is obtained by converting and calibrating the data by referring to a table. Then, the channel in which the ON/OFF bit is OFF in the same key number is searched in the assignment memory 21 in step (27), and the conditions are branched in step (28). This is because, if the ON/OFF bits are not assigned for the same channel but are assigned for another channel as described above when ON and OFF are repeated in the same key, volume level gradually increase so as to become unnatural in the case of tone color having long duration. When the same channel is searched according to the condition branching in step (28), the ON/OFF bit of the searched channel of the closed-keys sequence memory 22 is set to ON, the initial touch data obtained in step (26) is written in the assignment memory 21, and a new key number, key ON data, and speed with which the key is closed are written in the searched channel in the assignment memory 21 in step (33) to set the ON/OFF bit to ON. Since the key number is the same as before at this time, it is not written in the memory. When the same key number is not searched even if all 12 channels are searched in the condition branching in step (28), the process is transferred to condition branching in step (29) for searching for the channel of key OFF in the closed-keys sequence memory 22. This process operates to sequentially check only the ON/OFF bits from the preceding address of the closed-keys sequence memory 22 and to use the key OFF channel discovered initially as the searched channel. Then, step (31) for searching the channel in which the key is depressed least recently of the key OFF channels of the said closed-keys sequence memory 22 is executed.

When the ON/OFF bits from the preceding address to the final address of the closed-keys sequence memory 22 are all ON, the addressing of the memory 22 is aligned in the older sequence of the key ON from the preceding address. Thus, the channel indicating the head of the memory 22 is used as the searched channel in step (32).

After the steps (30), (31), (32) are all finished, a new key number, key ON data, and speed with which a key is closed are written in the searched channel in the assignment memory 21 in step (33) to assign them in the memory 21. Then, the closed-keys sequence memory 22 is processed in steps (34) to (41) as below. The preceding address of the closed-keys sequence memory 22 is set in the priority sequence counter 32 in step (34). The channel name is read out from the closed-keys sequence memory 22 in step (35). Whether there is a channel the same as the searched channel is searched in step (36). When there is no channel the same as the searched channel and there is +1 in the priority sequence counter 32 in step (37), whether the priority sequence counter 32 is overcounted is checked in step (37), and if an error occurs in step (39), the process is jumped to a reset routine at power source ON time. When there is the same channel as the searched channel in step (36), the same channel name is disposed from the closed-keys sequence memory 22, and the content of the closed-keys sequence memory 22 after this address is popped up in step (40). Then, the searched channel name and key ON data are written in the last address of the closed-keys sequence memory 22 in step (41). Then, the bit corresponding to the old key data (SW2) is written in the old key data memory 28 to set to key ON in step (42), thereby ending the key ON process.

The assignment memory 21 will be described. FIG. 6 shows the data storage state of the assignment memory 21. The assignment memory 21 stores data of 12 channels as necessary information for producing tones. Each channel has 2 bytes. The first byte stores ON/OFF information and key number information of the key, which are respectively 1 bit and 7 bits. The second byte stores initial touch information (closed-key speed information) and zone information, which are respectively 6 bits and 2 bits. After the key switch 1 is scanned to check ON/OFF of the key in which state change occurs, the processed data is stored in the assignment memory 21 to control the musical tone signal generator, thereby starting or stopping tone generation.

The closed-keys sequence memory 22 is constructed of a memory (in case of 12 channels) having 12 bytes similar to the assignment memory 21 as shown in FIG. 7. Each channel has 1 byte for storing key ON/OFF information and assigned channel number, which are respectively 1 bit and 4 bits. The memory 22 stores the channel of the assignment memory 21 when key ON is assigned in the channel of the assignment memory 21 to indicate the ON/OFF of the key. This memory 22 is of the type for storing the oldest channel name in the preceding address. Referring to FIG. 8, showing only the first bits of the closed-keys sequence memory 22, addresses "0", "1", "2", . . . , "11" are arranged in order from the left side. FIG. (8-1) shows default state when a power source is turned ON (at resetting time), in which the key depressed at the initial power source ON time is assigned for channel "0". Then, as shown in FIG. (8-2), if there is a new closed-key and there is no channel of equal key number in the key OFF channels when four channels "A, 1, 5, 6" are key ON and the other channels are key OFF, channel "B" that is least recently closed key of the key OFF channels is searched, and the priority sequence of the channel is as shown in FIG. (8-3). As shown in FIG. (8-4), the priority sequences thus disposed in FIG. (8-3) are all shifted to addressed of left side having addressing number smaller by one. As shown in FIG. (8-5), newly assigned channel "B" is written in the last address. When the channel "B" becomes key OFF, it becomes as shown in FIG. (8-6). When the key of the same key number as the channel "B" is newly keyed ON, it becomes as shown in FIG. (8-7). This is the process of the closed-keys sequence memory 22 when ON/OFF of the same key is repeated.

Then, as shown in FIG. (8-8), when 12 channels are all key ON and there is a further newly depressed key, since there is no key OFF channel, the key is assigned for the least recently depressed key in the key ON channel, i.e., in the channel "A" for storing the leftmost old address as shown in FIG. (8-9). Therefore, the content of the following address is shifted (popped up) by one, it becomes as shown in FIG. (8-10), the channel "A" is written in the last unfilled address to become as shown in FIG. (8-11).

According to the present invention as described above, the closed-keys sequence memory and the assignment memory can be effectively used without released a-keys sequence memory. Since the microprocessor is used to reduce the number of programming steps by approx. $\frac{2}{3}$ as compared with the case of the conventional later-closed-key priority system, required processing time is decreased.

What is claimed is:

1. A key assigner system for an electronic musical instrument, said system including:

an assignment memory (21) having an assignment channel number N equal to or less than a number of signal sources of a musical tone signal generator for storing information such as a key number and/or an ON/OFF state of a key;

a closed-keys sequence memory (22) having a capacity of N words for storing a channel name; and a processor (20) for controlling to write or read ON/-OFF states of key switches (1) in accordance with information from scanning an ON/OFF state of key switches;

said system further comprising:

first detecting means, having at least one key OFF channel in assignment memory (21), for detecting the least recently closed key channel among key OFF channels according to information in closed-keys sequence memory (22) when a newly closed key is detected, to assign the least recently closed key channel as the channel of the newly closed key, and second detecting means for detecting a channel of the least recently closed key of key ON channels according to information in the closed-keys sequence memory (22) when N channels are all in a key ON state and a newly closed key is detected, to assign the channel of the least recently closed key of key ON channels as the channel of the newly closed key, wherein the least recently closed key is forcibly cleared, and the newly closed key is assigned to the channel of the least recently closed key, and wherein only said closed-keys sequence memory is required for assigning priority to later-closed keys, without storage of a sequence in which closed keys are released.

2. The key assigner system as claimed in claim 1, further comprising assigning means for assigning a newly closed key having the same key number as the key number of a channel assigned already in the assignment memory (21) for the channel having the same key number when the newly closed key having the same key number as the key number of the channel already assigned in the assignment memory (21) is generated.

3. The key assigner system as claimed in claim 1, further comprising a key detector (24) including a key scanner (25) for scanning a plurality of key switches, an initial touch data memory (26) for storing a plurality of detected speeds with which keys are closed, and a new key data memory (27) for storing data corresponding to a status of most recently closed ones of said plurality of key switches.

4. The key assigner system as claimed in claim 1, further comprising an old key data memory (28) for storing previously scanned data to detect a state of later closed-key data, a key scanner (25) for repetitively scanning key states, an initial touch data memory (26) for storing a detected speed with which a key is closed, a zone counter (29), a key scan counter (30), and a bit counter (31) which are incremented during repetitive scanning of said key states until a state change occurs in the data of the initial touch data memory, and a priority sequence counter (32) for setting an address of the closed-keys sequence memory (22).

5. The key assigner system as claimed in claim 4, further comprising a new key data memory (27) for storing newly-closed key data, and EXCLUSIVE-OR means (33) for comparing contents of said old key data memory and said new key data memory, said first and second means assigning said least recently-closed key channel when said comparing indicates that said contents of said old key data memory and said new key data memory are different.

* * * * *